US005536896A

United States Patent [19]

Hesböl et al.

[11] Patent Number: 5,536,896

[45] Date of Patent: Jul. 16, 1996

[54] WASTE PROCESSING

[75] Inventors: Rolf Hesböl, Nyköping, Sweden; Lars E. Holst, Essen, Germany

[73] Assignee: Studsvik Radwaste AB, Nykoping, Sweden

[21] Appl. No.: 403,758

[22] PCT Filed: Aug. 4, 1993

[86] PCT No.: PCT/SE93/00653

§ 371 Date: Mar. 17, 1995

§ 102(e) Date: Mar. 17, 1995

[87] PCT Pub. No.: WO94/07088

PCT Pub. Date: Mar. 31, 1994

[30] Foreign Application Priority Data

Sep. 17, 1992 [SE] Sweden ..... 9202690

[51] Int. Cl.[6] ..... G21F 9/00

[52] U.S. Cl. ..... 588/19; 588/240; 588/216; 110/237; 110/346

[58] Field of Search ..... 588/19, 238–240, 588/216; 110/346, 237

[56] References Cited

U.S. PATENT DOCUMENTS

| | | | |
|---|---|---|---|
| 4,053,432 | 10/1977 | Tiepel et al. . | |
| 4,303,477 | 12/1981 | Schmidt et al. | 201/2.5 |
| 4,347,226 | 8/1982 | Audeh et al. | 423/207 |
| 4,573,418 | 3/1986 | Marzendorfer et al. | 110/345 |
| 4,602,573 | 7/1986 | Tanca | 110/342 |
| 4,628,837 | 12/1986 | Mori et al. | 110/346 |
| 4,636,335 | 1/1987 | Kawamura et al. | 252/629 |
| 4,654,172 | 3/1987 | Matsuda et al. . | |
| 4,762,647 | 8/1988 | Smeltzer et al. . | |

FOREIGN PATENT DOCUMENTS

| | | |
|---|---|---|
| 8405113 | 1/1988 | Sweden . |

*Primary Examiner*—Ngoclan Mai

*Attorney, Agent, or Firm*—Burns, Doane, Swecker & Mathis

[57] ABSTRACT

A method for the processing of solid organic sulfur-containing waste, in particular ion exchange media, from nuclear facilities, which method comprises that in a first step a) the waste is subjected to pyrolysis at the most at 700° C. in a step b) the gas resulting from step a) is subjected to pyrolysis, in an optional step c) the gas resulting from step b) is exposed to a reductant bed, and in a step d) the gas from step b) or alternatively step c) is exposed to a bed of sulphide-forming metal to form metal sulphides and easily manageable harmless gases. Apparatus for carrying out the method comprises A) a pyrolysis reactor for the solid waste, B) a pyrolysis reactor for the gas from A), C) optionally, a reductant bed, and D) a bed of sulfur-forming metal for the gas from B) or C).

43 Claims, 1 Drawing Sheet

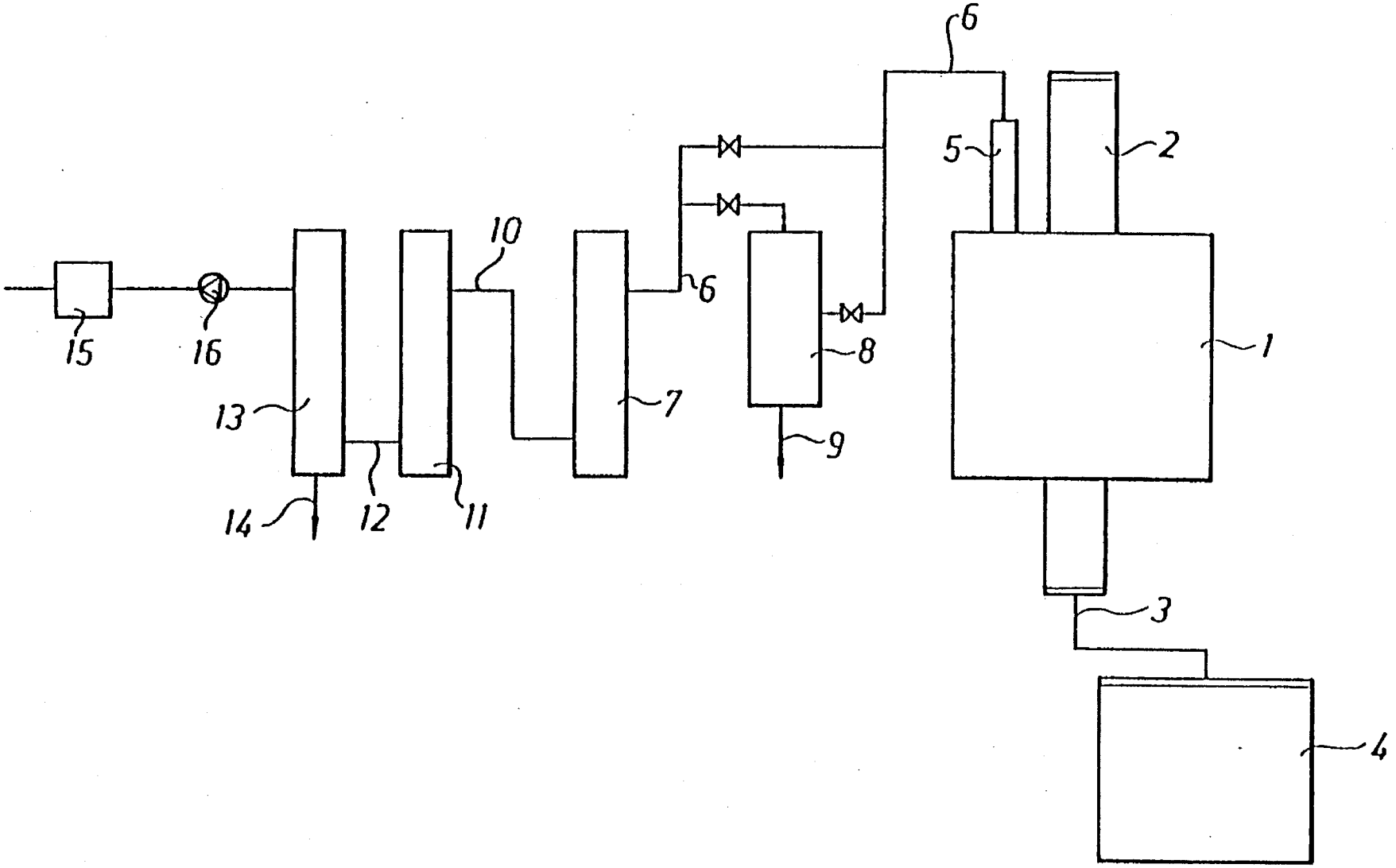
1
2
3
4
5
6
6
7
8
9
10
11
12
13
14
15
16

WASTE PROCESSING

TECHNICAL FIELD

The present invention relates to the field of processing organic waste, "processing" in the present case referring to the breaking down of said waste via the thermal route with the primary aim of affording opportunities for reducing its volume to thereby lessen handling and storage problems. More particularly, it concerns a new method and new apparatus for processing solid organic sulphur-containing waste in which the thermal breakdown embraces pyrolysis of the waste. The new method of the invention not only achieves the aim of volume reduction, but also provides, for example, such benefits as the elimination of the sulphur content from the exhaust gases, and similarly any radioactive content, in an effective and straight forward manner. The invention is therefore especially useful for the processing of ionic exchange media from nuclear facilities, which media display a certain degree of radioactivity and therefore would otherwise require conventional measures in relation to ultimate waste disposal and deposition.

BACKGROUND OF THE INVENTION

The nuclear industry annually produces a significant amount of waste which is classified as radioactively contaminated ion exchange media. In Sweden, such waste is managed in various fashions in the individual nuclear facilities prior to ultimate disposal in bedrock chambers. This management is technically complex and as a rule leads to increased volumes which influences storage costs. A process resulting in diminished volume at reasonable cost should therefore be commercially interesting.

Ion exchange medium is an organic material. The base is usually a styrene polymer with grafted sulphonic acid and amine groups. The material is therefore burnable, but air is supplied during combustion and sulphur and nitrogen oxides are formed which in turn must be separated in some manner. Additionally, during combustion the temperature becomes sufficiently high for radioactive caesium to be partially vapourised. The residual radioactivity will also accompany the resulting fly ash to some extent. This necessitates a very high performance filter system. Accordingly, both technical and economic problems are associated with the combustion technique.

An alternative to combustion is pyrolysis. However, previously known pyrolysis methods in this technical field are deficient in several aspects and in particular no one has earlier succeeded in devising a pyrolysis process which provides a comprehensive solution to the problem of sulphur and nitrogen-containing radioactive waste, and to do so under acceptable economic stipulations. The following can be mentioned as examples of the known technology in this respect:

SE-B 8405113-5 which describes single stage pyrolysis in a fluidised bed followed by conversion of tars in the resulting gas to non-condensable gas using limestone as catalyst.

U.S. Pat. No. 4,628,837, U.S. Pat. No. 4,636,335 and U.S. Pat. No. 4,654,172 which all describe pyrolysis of ion exchange resins where the pyrolysis is certainly carried out in two stages but where both of these stages are directed towards pyrolysis of the ion exchange media itself i.e. the solid product. Speaking generally, both stages moreover are carried out at relatively low temperatures. Furthermore, none of these specifications recites any comprehensive solution to the problem of solid organic sulphur-containing waste such as is the case with the method of the present invention.

DESCRIPTION OF THE INVENTION

The principal objective of the present invention is to provide a method for processing solid wastes of the abovementioned type, which method results in a "dead" (to use a biological term), compactable pyrolysis residue and thereby an effective reduction in the volume of the waste.

Another objective of the invention is to provide a method which, in addition to the abovementioned volume reduction, affords effective processing of the resulting exhaust gases.

A further objective of the invention is to provide a method which also affords an extremely high retention of the radioactivity present in the pyrolysis residue.

A still further objective of the invention is to provide a method which is straight forward in technical respects and which is therefore also cost effective taking everything into account as regards volume reduction of the solid waste and management of the resulting exhaust gases.

The abovementioned objectives are attained via a method which in general terms can be thought of as a two step pyrolysis, in which it is essential that the first pyrolysis step is carried out on the solid waste and at a relatively low temperature while the second pyrolysis step is carried out on the resulting gases and at a higher temperature, these two pyrolysis steps being followed by a step in which the gas is exposed to a sulphide-forming metal, optionally after an intermediate step in which the gas is first subjected to reducing conditions.

More particularly, the method of the invention is distinctive in that a) the waste is subjected to pyrolysis at a temperature of at the most 700° C., preferably 600° C. at the most, to form a gas which contains organic sulphur compounds, and a solid pyrolysis residue which contains radioactive material from the waste, b) the gas is separated from the pyrolysis residue and subjected to a pyrolysis, which can alternatively be designated as cracking, for breaking down the organic sulphur compounds in the gas to carbonaceous compounds with a lower or low number of carbons and inorganic sulphur compounds, c) optionally exposing the gas from step b) to a bed of a solid reductant under reducing conditions so that any sulphur oxides present are reduced to hydrogen sulphide, and d) exposing the gas from step b), or alternatively step c) if this was carried out, to a bed of a sulphide-forming metal under conditions in which the sulphur compounds from the preceding step form metal sulphides with said metal.

In other words, the initial step involves subjecting the solid waste to pyrolysis at a temperature of 700° C. at the most, preferably 600° C. at the most, the term "pyrolysis" being used in its conventional sense, i.e. chemical decomposition or breakdown of a substance by the action of heat and without any real supply of oxygen or at least so little oxygen supply that no real combustion is effected. The pyrolysis thereby leads to breaking down of the carbonaceous waste to a relatively fluffy pyrolysis residue which can be drawn off from the bottom of the pyrolysis reactor employed and can thereafter be imparted a significantly smaller volume by compression. Additionally, by keeping the temperatures no higher than those recited above, practically speaking all of the radioactive materials, in particular $^{137}Cs$, are retained in the pyrolysis residue and therefore measures and consequent costs to remove additional radioactivity can be minimized. Any fly ash formed can, however, be removed from the resulting gas in a per se known manner, preferably in a ceramic filter in the pyrolysis reactor. In this way, the radioactive material in the fly ash caught in the filter can be returned to the pyrolysis residue.

In the practice of the invention, it has proven possible in this fashion to attain very high retention of the radioactivity in the pyrolysis residue. In this regard, trials carried out on ion exchange media from a nuclear power station show a retention of almost $10^6$:1, i.e. the decontamination factor DF is of the order $10^6$. Aside from said radioactive material, the pyrolysis residue contains carbon and possibly iron compounds such as iron oxides and iron sulphides. Trials in this connection, show the retention of sulphur in the pyrolysis residue to be >90%.

No immediately critical lower limit is apparent for the pyrolysis in step a) but rather this limit is dictated, if anything, by effectiveness and/or cost. However, for practical purposes, a lower limit can generally be set at 400° C. and therefore a preferred embodiment of the method of the invention involves stage a) being carried out at a temperature in the range 400°–700° C., preferably 400°–600° C., especially 450°–600° C., e.g 450°–550° C.

Additionally, as the method of the invention as a whole has proven to be extremely effective both as regards the solids content and the evolved gases, step a) is preferably carried out without any catalyst for the breakdown of the carbon compounds in the waste which, of course, means that the method of the invention is very cost effective as the catalyst costs in comparable contexts often represent a large part of the total costs.

Pyrolysis step a) can be carried out in per se known fashion as regards the type of pyrolysis reactor, e.g. in a fluidized bed, but in the overall set-up of the method in the context of the invention, "flash pyrolysis" has proven to give exceptionally good results. The expression flash pyrolysis is used herein in its conventional sense, i.e. with a relatively rapid flow-through of material. In other words, it is a matter of a short residence time, normally less than 30 seconds and even more usually a significantly shorter time, e.g. less than 15 seconds. An especially preferred flash pyrolysis is carried out in a gravity or flash reactor for which a suitable residence time can be 3–15 seconds, even better 4–10 seconds, e.g. 5–8 seconds such as around 6 seconds. Suitable residence times are, however, easily determined by the man skilled in the art in each individual case.

In the present case, it will be understood that "solid waste" does not concern a solution of the material in question. It need not however necessarily concern a dry material but also material with a certain degree of moisture content, e.g. up to 50%, usually 10–30% such as is often the case when using ion exchange media. However, for flash pyrolysis, for example, it can be convenient to condition the material prior to pyrolysis a), which means a certain degree of drying and optionally, comminution. In this regard, a material in powder form has proven to give very good results in the initial pyrolysis a).

The gas which is formed during pyrolysis in step a) contains decomposition products from the organic waste referred to as "tars". These tars principally contain pure hydrocarbons and water vapour, and organic sulphur compounds and amines when the waste is of the sulphur and nitrogen-containing ion exchange media type. The gas is separated from the pyrolysis residue and subjected to pyrolysis in a second step b) for which the temperature is selected in such a manner that, while paying attention to the other conditions, the organic sulphur-containing compounds therein with a moderately high number of carbons are cracked to compounds with a low or lower number of carbons and inorganic sulphur compounds. If the waste is nitrogen-containing, inorganic nitrogen compounds are formed as well. The temperature for step b) is selected, in other words, generally in accordance with the composition of the gas resulting from step a). Usually this means that the temperature of step b) is higher than that of step a), at least if a cracking catalyst is not used. If the temperature of step a) is high, this can, for example, mean that the temperature of step b) is higher than 700° C. However, especially when a cracking catalyst is used as is further described below, the temperature of step b) can lie somewhat below the temperature of step a), or at least lower than the upper limit for step a). This can mean a temperature in excess of 600° C. or more preferably in excess of 650° C. The upper temperature limit is not especially critical as regards the desired breakdown but rather it is processing technology (materials science) or economic factors which set this upper limit. For example, it can thus be difficult from a cost effectiveness viewpoint to utilize materials which withstand a higher temperature than around 1500° C. A preferred temperature is therefore up to 1500° C. However, a more optimal upper temperature limit is 1300° C. and therefore a convenient temperature range, especially without a catalyst, is above 700° C. and up to 1300° C. A particularly preferred temperature range for step b) is, however, above 700° C. and up to 1000° C. and best of all above 700° C. and up to 850° C.

Corresponding preferred temperatures when using a catalyst are 600°–1300° C., especially 650°–1300° C. or better still 650°–1000° C., e.g 650°–850° C.

The pyrolysis conditions for step b) are, however, not nearly as critical as for step a), in that it is primarily a matter of a complete breakdown of the sulphur content and any nitrogen containing carbon compounds with a moderate number of carbons to carbon compounds with a lower number of carbons, without any immediately interfering side-reactions or biproducts. Therefore, the pyrolysis in step b) can alternatively also be denoted as cracking in accordance with generally accepted terminology. Cracking leads to a high production of soot. The higher the temperature, the more soot is formed. The soot production will probably require high temperature filtration of the cracking gases, for which conventional techniques are available. A simpler and more timesaving methodology, however, is the previously described tar condensation prior to cracking. The condensation alternative additionally leads to good separation of the organic sulphur compounds.

By analogy with the above, step b) can therefore also be conveniently carried out, in certain cases as touched on above, in the presence of a cracking catalyst known in the past in similar contexts. Lime, e.g. dolomite lime, can be mentioned as such a catalyst in connection with step b).

When the gases from step a) contain tar products and water, a preferred embodiment of the method of the invention thus involves the gas, prior to step b), being subjected to condensation conditions such that tar products therein condense out and are separated before the gas is conducted to said step b). In this context, "tar products" will be understood to include carbonaceous compounds which are, of course, in gaseous form after pyrolysis in step a) but which drop out in the form of a more or less viscous tar mixed with water. The condensate can be separated by fractionated condensation into a low viscosity tar of high calorific value, water and a viscous sulphur-rich tar. Greater refinement of the pyrolytic or cracking process in step b) is brought about through said tar separation and thereby more cost effective execution.

If sulphur oxides, especially $SO_2$, are present in the gases emanating from the pyrolysis step, they must be attended to in an appropriate manner bearing in mind the strict requirements which now apply to the release of sulphur oxides and other sulphur compounds.

This is attained in a simple and effective fashion in the method of the invention directly in the integrated process by virtue of the gas from stage b) being exposed in a stage c) to a bed of a solid reductant under reducing conditions so that the sulphur oxides are reduced, principally to hydrogen sulphide and carbon disulphide. Carbon, in particular, has proven to work extremely well as a reductant in relation to the method of the invention. Additionally, carbon results in the sort of end products, especially carbon dioxide, which are harmless and in principle can be released direct to the atmosphere.

The temperature for the step c) reduction is selected by the man skilled in the art in this field in such a fashion that the sought after reactions are attained. This preferably means that the reduction is carried out at a temperature in the range 700°–900° C., the approximately 800° C. temperature level probably lying near the optimum.

Step c) additionally leads to a reduction in nitrogen oxides in the event that these are present in the gas after the pyrolysis steps. In the event that a high temperature filter of the carbonaceous filter type or similar is utilized for filtering out the soot in the post step b) gas, this filter can be regarded as a reduction means for use in the optional step c) of the invention.

Finally, the gas in a step d) is exposed to a bed of a sulphide-forming metal under conditions in which the remaining sulphur compounds form metal sulphides with said metal. In this context, it is the gas from reduction step c), if present, or the gas from the second pyrolysis step b). In each case it is primarily a matter of transforming hydrogen sulphide to metal sulphide. Preferably, iron is used as sulphide-forming metal as iron is a cheap material and results in a harmless product, principally in the form of the iron disulphide, pyrite. Other metals, however, are also conceivable of which nickel can be mentioned as an example. The temperature for this step d) is also selected by the man skilled in the art in this field so that the sought after reactions are attained. An especially preferred temperature range, however, is 400°–600° C., the approximately 500° C. level being especially suitable in many cases.

Very volatile organic gases which do not condense out in the condensation step and which form during cracking also penetrate the reductants used in step c) and the sulphide forming reactor used in step d). Effluent requirements for these materials in Sweden are such that conversion or separation is required. When the gases are oxidizable, they can be destroyed by oxidation (combustion), e.g. catalytic oxidation. Oxidation is suitable for the pyrolysis of ion exchange media because the exhaust gases are chlorine-free and therefore no dioxins are formed.

As has been touched upon earlier, both the solid end-product and the gaseous end-products of the method of the invention are amenable to handling. The resulting ash, for example, is thus particularly suitable for post-treatment in the form of simple compression, where the practice of the invention has proven that the volume can be reduced by as much as up to 75%. Furthermore, the resulting gases are rich in light organic compounds which implies a gas with a high heat content which can be burnt. Additionally, the sort of gases being referred to are non-injurious to the surroundings, e.g. carbon dioxide, gaseous nitrogen, gaseous hydrogen and water vapour, and therefore the method of the invention, as a whole, represents unparalleled advantages in relation to the known technique.

In order that the method should proceed in an effective fashion and especially in order that the release of radioactive or unpleasant or dangerous gases through system leakage should be avoided, with consequent risks to working personnel, a further preferred embodiment involves carrying out the method under a certain degree of vacuum or negative pressure, conveniently by arranging a suction pump or gas evacuation pump downstream of step d).

The invention additionally relates to apparatus for carrying out the method of the invention, which apparatus comprises:

A) a pyrolysis reactor for carrying out pyrolysis on the solid waste, preferably at a temperature in the range 400°–700° C., especially 400°–600° C., B) a pyrolysis or cracking reactor for carrying out pyrolysis on the gases emanating from reactor A), preferably at a temperature in the range above 700° C. and up to 1300° C. when a catalyst is not used and 600°–1300° C. when a catalyst is present, C) optionally, a bed of a solid reductant for the reduction of any sulphur dioxide present in the gas, and D) a bed of a sulphide-forming metal for the formation of metal sulphide with the gas from step B) or alternatively with the gas from step C).

Additionally, as regards the apparatus of the invention, all of the features and preferred embodiments of the method described above are also suitable in connection therewith. These details therefore need not be repeated.

However, the following especially preferred embodiments of the apparatus can be mentioned.

Specifically, the pyrolysis reactor A) is a gravity reactor.

Preferably, a condenser for the condensation of tar products in the gas is located prior to reactor B).

A filter for the separation of any fly ash from the gas is preferably located in reactor A).

The apparatus preferably includes a filter for the separation of soot from the gas from reactor B).

Preferably a compactor is included for compression of the pyrolysis residue resulting from reactor A).

Conveniently, an afterburner is present after bed D) for combustion of said gas.

DESCRIPTION OF THE DRAWING

An embodiment of apparatus in accordance with the invention is schematically depicted in the accompanying drawing.

The depicted apparatus comprises the following units and works in the following fashion. Solid waste is fed to a first pyrolysis reactor 1 of the gravity type via a feed 2. After pyrolysis of the solid waste in said reactor 1, the solid pyrolysis residue (ash) is drawn off via a screw 3 to a container 4, which optionally contains a compressing device for said residue.

The gas formed during pyrolysis in reactor 1 is afterwards conducted via a ceramic filter 5 and a conduit 6 to a second pyrolysis reactor 7, where it is subjected to pyrolysis under the earlier stated conditions. In the depicted embodiment of the apparatus of the invention, a condenser 8 is additionally present, which is connected up as necessary if the gas contains tar products which need to be condensed out before pyrolysis reactor 7. In such a case, these tar products are drawn off from the condenser 8 via a withdrawal conduit 9.

The gas pyrolysed in reactor 7 is conducted via conduit 10 to a reductant bed of carbon 11 where sulphur oxides present are reduced to hydrogen sulphide and carbon disulphide.

The reduced gas from bed 11 is then transferred via conduit 12 to a bed 13 of sulphur-forming metal, e.g. iron. The metal sulphide formed can then be drawn off via conduit 14 from the bottom of said bed 13. If iron is used as a metal in the bed, this means that the withdrawn metal sulphide principally comprises pyrite.

The depicted embodiment of the apparatus of the invention additionally comprises a burner 15 for the final oxidation or combustion of the exhaust gases and a pump 16, which in this embodiment is placed between bed 13 and burner 15 and which is intended to provide negative pressure in the apparatus.

We claim:

1. A method for the processing of solid organic sulphur-containing waste from nuclear facilities comprising:

(a) subjecting said waste to pyrolysis at a temperature of no more than 700° C. to form a gas which contains organic sulphur compounds, and a solid pyrolysis residue which contains radioactive material from the waste, (b) separating said gas from the pyrolysis residue and pyrolyzing or cracking said gas following separation to break down the organic sulphur compounds in the gas to carbonaceous compounds having a lower number of carbon atoms and inorganic sulphur compounds, and (c) contacting said gas following its separation and pyrolysis to a bed of a sulphide-forming metal under conditions in which the sulphur compounds present therein form metal sulphides of said metal.

2. A method according to claim 1 comprising subjecting said gas of step (a) to condensation conditions wherein tar products present therein condense out and are separated prior to step (b).

3. A method according to claim 1, wherein following step (a) any fly ash present in said waste is separated from said gas.

4. A method according to claim 1, wherein the pyrolysis of step (a) is carried out at a temperature in the range of 400°–700° C.

5. A method according to claim 1 wherein the pyrolysis of step (a) is carried out in the absence of a catalyst for the breaking down of carbon compounds that are present in the waste.

6. A method according to claim 1, wherein the pyrolysis of step (a) is carried out in a gravity reactor or a flash reactor.

7. A method according to claim 1, wherein the pyrolyzing or cracking of step (b) is carried out in the absence of a cracking catalyst and at a higher temperature than the pyrolysis of step (a).

8. A method according to claim 1, wherein the pyrolysis or cracking of step (b) is carried out in the presence of a cracking catalyst and at a temperature above 600° C.

9. A method according to claim 8, wherein the pyrolysis or cracking of step (b) is carried out in the presence of dolomite lime.

10. A method according to claim 1, wherein step (c) is performed at a temperature in the range of 400°–600° C.

11. A method according to claim 1, wherein the volume of said residue resulting from step (a) is reduced by compression.

12. A method according to claim 1, wherein said steps are carried out at a negative pressure.

13. A method according to claim 1, wherein following step (b) said gas is subjected to filtration.

14. A method according to claim 1, wherein following step (c) exhaust gas is subjected to oxidation.

15. Apparatus for the processing of solid organic sulphur-containing waste from nuclear facilities comprising:

(a) a pyrolysis reactor for carrying out pyrolysis on the solid waste, (b) a pyrolysis or cracking reactor to break down the organic sulphur compounds in the gas emanating from reactor (a), and (c) a bed of a sulphide-forming metal for the formation of metal sulphide with the gas from said pyrolysis or cracking reactor (b).

16. Apparatus according to claim 15, wherein pyrolysis reactor (a) is a gravity or flash reactor.

17. Apparatus according to claim 15, which includes prior to reactor (b) a condenser for the condensation of tar products present in the gas.

18. Apparatus according to claim 15, wherein a filter is provided in reactor (a) for the separation of any fly ash from the gas.

19. Apparatus according to claim 15, wherein a filter is provided for the separation of soot from the gas exiting from reactor (b).

20. Apparatus according to claim 15, wherein a compactor is provided for the compression of pyrolysis residue resulting from reactor (a).

21. Apparatus according to claim 15, wherein an afterburner is provided after bed (c).

22. A method according to claim 2, wherein after step (a) any fly ash is separated from the gas.

23. Apparatus according to claim 16, wherein prior to reactor (b) a condenser is provided for the condensation of coal tar products in the gas.

24. A method according to claim 1, wherein said solid organic sulphur-containing waste is an ion exchange medium and said method reduces the volume of said waste.

25. A method according to claim 1 wherein said pyrolysis of step (a) is carried out at a temperature of no more than 600° C.

26. A method according to claim 1 wherein said pyrolysis of step (a) is carried out at a temperature in the range of 400° to 600° C.

27. A method according to claim 1 wherein said pyrolysis step (a) is carried out at a temperature in the range of 450° to 550° C.

28. A method according to claim 1 wherein following step (b) and prior to step (c) the gas resulting from step (b) is subjected to reducing conditions wherein any sulphur oxides that are present are reduced to hydrogen sulphide.

29. A method according to claim 6 wherein said pyrolysis of step (a) is carried out for a residence time of less than 10 seconds.

30. A method according to claim 6 wherein said pyrolysis of step (a) is carried out for a residence time of 5 to 8 seconds.

31. A method according to claim 7 wherein said pyrolyzing or cracking of step (b) is carried out at a temperature above 700° C.

32. A method according to claim 7 wherein said pyrolyzing or cracking at step (b) is carried out at a temperature in the range above 700° C. to 1300° C.

33. A method according to claim 7 wherein said pyrolyzing or cracking of step (b) is carried out at a temperature in the range above 700° C. to 1000° C.

34. A method according to claim 7 wherein said pyrolyzing or cracking of step (b) is carried out at a temperature in the range above 700° C. to 850° C.

35. A method according to claim 8 wherein said pyrolyzing or cracking of step (b) is carried out at a temperature in the range of above 600° C. to 1300° C.

36. A method according to claim 8 wherein said pyrolyzing or cracking of step (b) is carried out at a temperature in the range of 650° C. to 1300° C.

37. A method according to claim 28 wherein said reducing conditions are carried out at a temperature in the range of 700° C. to 900° C.

38. A method according to claim 28 wherein said reducing conditions are carried out at a temperature of approximately 800° C.

39. A method according to claim 1 wherein step (c) is performed at a temperature of approximately 500° C.

40. A method according to claim 13 wherein said filtration is performed with the use of a carbon filter.

41. Apparatus according to claim 15 wherein a bed of solid reductant for the reduction of any sulphur dioxide gas present in gas that leaves pyrolysis or cracking reactor (b) is situated intermediate pyrolysis or cracking reactor (b) and bed (c).

42. Apparatus according to claim 18 wherein said filter is a ceramic filter.

43. Apparatus according to claim 19 wherein said filter is a carbon filter.

* * * * *